US005465446A

United States Patent [19]

Chang

[11] Patent Number: 5,465,446

[45] Date of Patent: Nov. 14, 1995

[54] HIGH-RISE BUILDING CLEANING MACHINE

[76] Inventor: Kai-Kuo Chang, 1F 50, Alley 401 Lane 150 Sec. 5 Hsin I Road, Taipei, Taiwan

[21] Appl. No.: 368,347

[22] Filed: Jan. 4, 1995

[51] Int. Cl.[6] ..... A47L 1/02

[52] U.S. Cl. ..... 15/50.3; 15/52.1; 15/103

[58] Field of Search ..... 15/49.1, 50.1; 15/50.2, 50.3, 51, 52, 52.1, 52.2, 98, 103, 250.11, 302

[56] References Cited

U.S. PATENT DOCUMENTS

| | | | |
|---|---|---|---|
| 3,056,153 | 10/1962 | Laghter, Sr. | 15/50.1 |
| 3,292,193 | 12/1966 | Littin | 15/50.3 |
| 3,298,052 | 1/1967 | Wolfe | 15/50.3 |
| 3,344,454 | 10/1967 | Mikalson | 15/50.3 |
| 3,497,902 | 3/1970 | Hartigan | 15/302 |
| 3,641,607 | 2/1972 | Lemelson | 15/50.3 |
| 4,257,138 | 3/1981 | Clements et al. | 15/50.3 |

FOREIGN PATENT DOCUMENTS

| | | | |
|---|---|---|---|
| 252862 | 4/1964 | Australia | 15/50.3 |
| 1350632 | 12/1963 | France | 15/50.3 |
| 2032997 | 7/1970 | Germany | 15/50.3 |
| 1628595 | 8/1970 | Germany | 15/50.3 |
| 1937644 | 1/1971 | Germany | 15/50.3 |
| 2748142 | 5/1979 | Germany | 15/50.3 |
| 3235227 | 3/1984 | Germany | 15/52.1 |
| 3503049 | 7/1986 | Germany | 15/302 |
| 361267 | 1/1973 | U.S.S.R. | 15/50.3 |
| 1131742 | 10/1968 | United Kingdom | 15/50.3 |

*Primary Examiner*—Mark Spisich

*Attorney, Agent, or Firm*—Morton J. Rosenberg; David I. Klein

[57] ABSTRACT

This present invention is a high-rise building cleaning machine that contains an elevator cage, a pair of washing rotary arms, one or more pairs of winding machines, driving motors, a control box, a water pump, an oil pressure pump, a horizontal brush set, and a vertical brush set, wherein the winding machines power the vertical movement of the elevator cage along the outer walls of a building, and the washing rotary arms, pivoted on two lateral sides in the elevator cage, can be turned around by 180 degrees by a driving motor; two transverse rods in parallel, with their two ends fixed at each of the rotary arms and separated by 180 degrees about the pivot axis, are installed for the attachment of a horizontal brush set and a vertical brush set respectively. The elevator cage is carried by the winding machines that is controlled by the control box to move vertically against the walls of a building, during which detergent water is ejected from the bottom end of the elevator cage onto the wall surface and the horizontal brush set and the vertical brush set, in company of the turning of the rotary arm, perform washing acts in the horizontal and the vertical directions; the state of washing is monitored by a monitor at the top end of the elevator cage. Therefore a fully automatic machine for washing the outer walls of a building is formed.

13 Claims, 4 Drawing Sheets

HIGH-RISE BUILDING CLEANING MACHINE

BACKGROUND OF THE INVENTION

1. Field of the Invention

The present invention relates to a high-rise building cleaning machine, which is a vertically moving cleaning machine especially applicable to the outer walls of high-rise buildings and which contains a pair of rotary arms that can automatically turn 180 degrees about a horizontal axis; a horizontal and a vertical brush sets are connected to two sides of the rotary arm pair, which forms a structure for automatic washing of the outer walls of high-rise buildings.

2. Description of the Prior Art

Following the rapid developments of architecture technology and modern economy, it is quite common that high-rise buildings of scores or even more than one hundred floors are constructed frequently in metropolitan areas, which brings the problem of cleaning the facings of high-rise buildings, a problem having become a central issue of the usage and maintenance of buildings of this kind.

Platforms that can move vertically are commonly installed in high-rise buildings for cleaning their outer walls. But personnel is needed to be carried with the platforms for manually controlling the positioning of the platforms and cleaning the walls, which brings about the following disadvantages:

(1) The control procedures are complex and the cleaning job is time consuming and labor-costly The prior structure of the platforms for cleaning the outer walls of high-rise buildings described above needs, in its operation, complex manual control for its elevation and man power for the cleaning that the work load for the personnel is heavy and the cleaning job as a result is particularly time-consuming and labor-costly.

(2) The limitation of manual cleaning brings blind spots

Besides the shortcomings of manual cleaning mentioned above in (1), there exists another disadvantage in the prior art, that is, the blind spots of cleaning on the large area of the outer walls of high-rise buildings due to the limited range of manual cleaning.

(3) Personnel is needed to carried with the prior cleaning platforms, which is of high risk The safety of the operating personnel used in the prior cleaning platforms is the biggest concern in that mistakes made by the personnel when operating the platforms or an accidental breakdown of its structure may cause the platforms to drop onto the ground; on the other hand, the abnormal turbulence in the air between high-rise buildings is also potentially hazardous.

SUMMARY OF THE INVENTION

For reasons described above the main purpose of the present invention is a new design of a high-rise building cleaning machine which contains an elevator cage whose elevation is powered by a pair of winding machines and is controlled by a control box and at the bottom of which several detergent jets are installed and are in cooperation with a water pump that supplies the water for cleaning the outer walls of a building; the main part is a pair of washing rotary arms taking their pivots on the rotor shafts of a pair of driving motors, controlling the arm pair to turn 180 degrees, installed on two lateral sides of the elevator cage.

Between and at two ends of the rotary arms, 180 degrees about their pivot axis, there respectively installed a horizontal and a vertical brush sets which can respectively wash the outer wall of a building in the horizontal and the vertical directions and in automation, taking their turn as the rotary arm pair rotates. Therefore, the object of this invention that the cleaning of the outer walls of high-rise buildings is fully automatic is achieved.

Another object of this invention is providing a new high-rise building cleaning machine in which two rails are formed on each of the lateral sides of the elevator cage, each containing a pulley rod and a sucker rod at its two ends; these rods are controlled by oil pressure to extend horizontally and toward a wall of a building, and via their contact with the wall the elevator cage is held in an appropriate position and stabilized. The safety and reliability of the operation of the elevator cage is thus insured.

DESCRIPTION OF THE PREFERRED EMBODIMENTS

Figure 1:
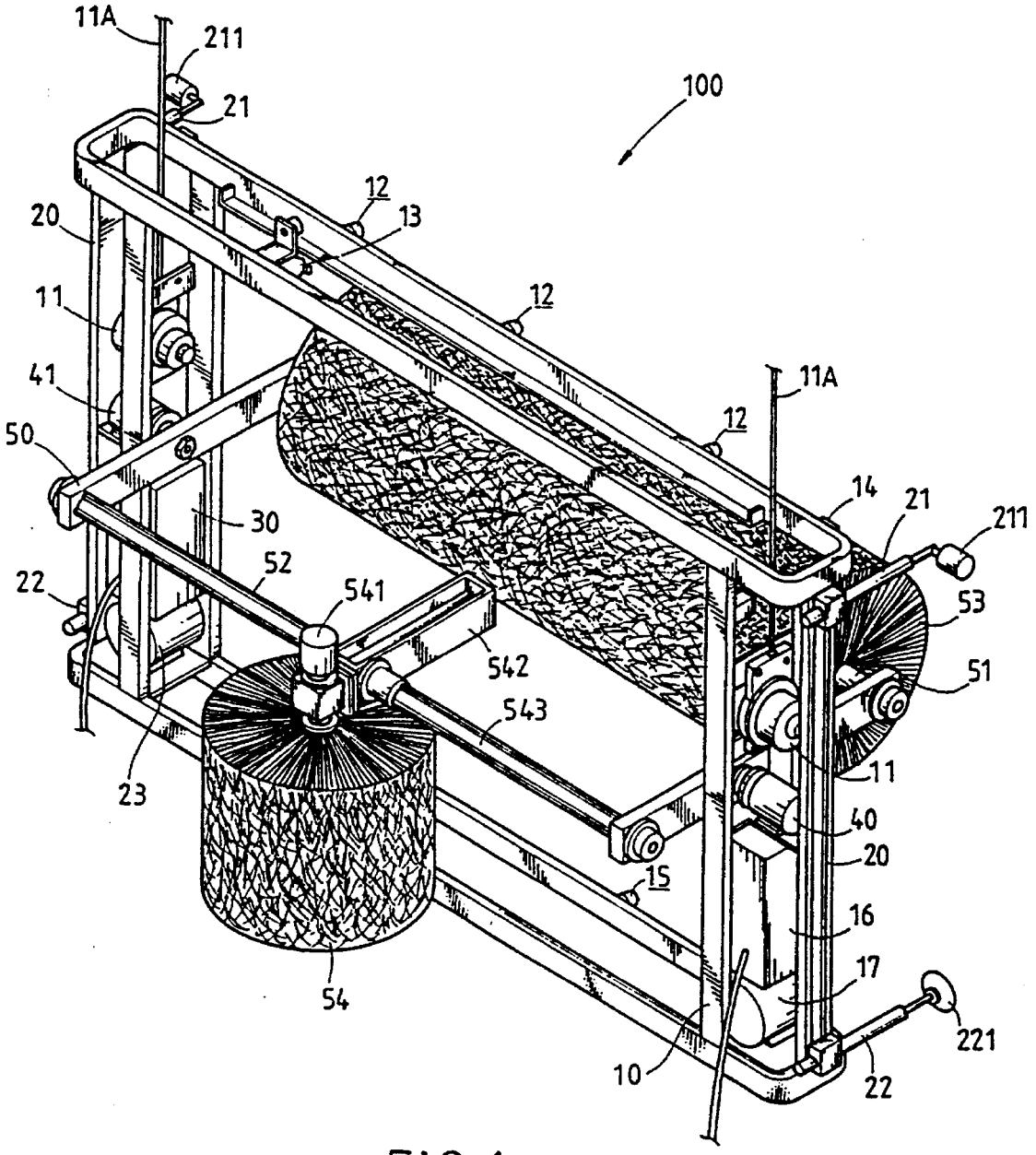
FIG. 1 shows the structure of the invention in three dimensions.
Figure 2:
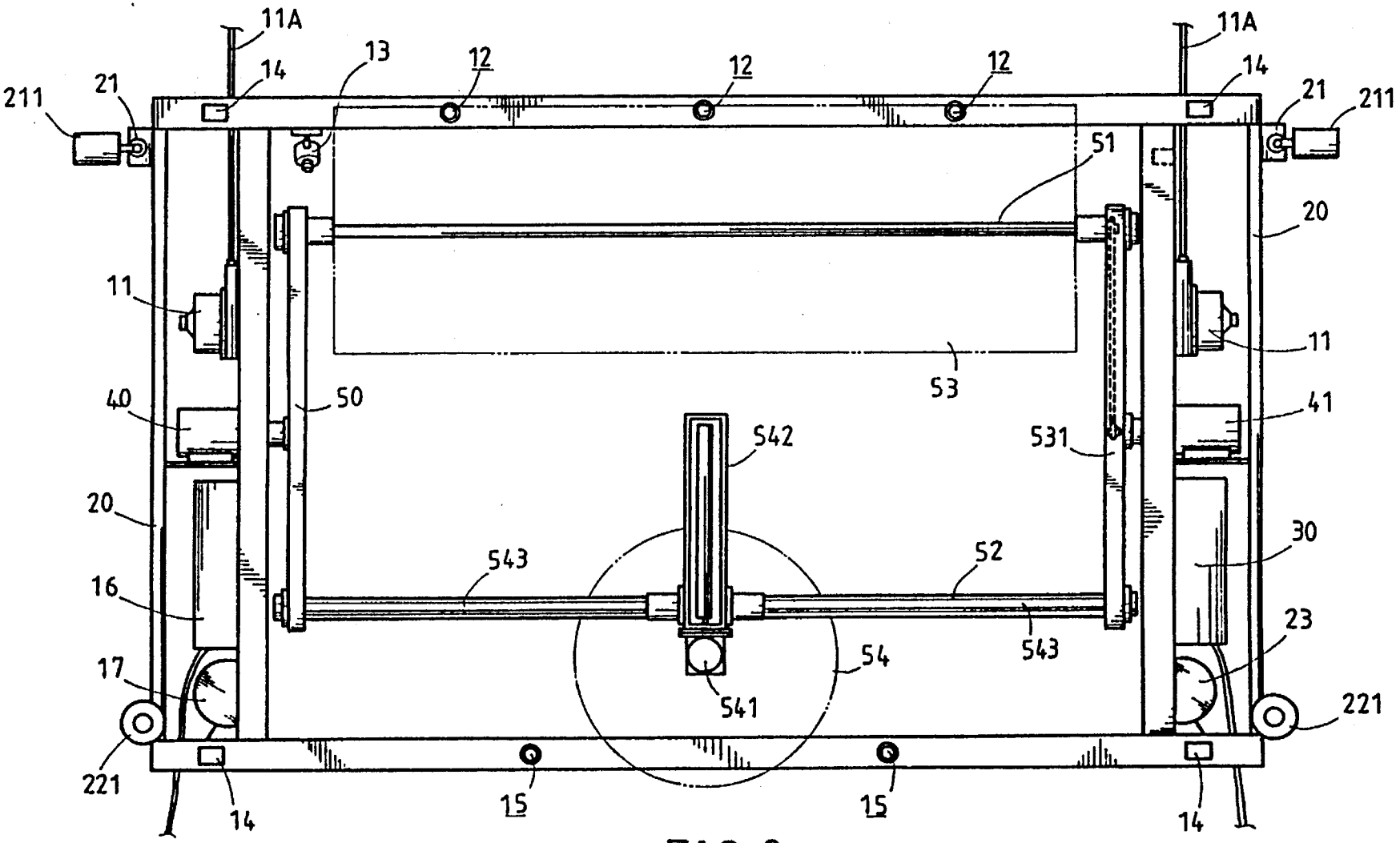
FIG. 2 is a top view of the invention.

As shown firstly in FIGS. 1 and 2 this invention is a high-rise building cleaning machine (100) that contains an elevator cage (10), taking a form of a rectangular frame, two winding machines (11) which are installed in the upper parts of the two lateral sides of the elevator and are connected to a support beam on the top of a building (not shown in the figures) through a steel cable (11A); the winding machines (11) thus control the movement of the elevator cage (10). Also on the inner side and the outer side on the top of the elevator cage (10) several cleaning water jets (12) and a monitor (13) are installed respectively, which supplies the water for the cleaning of the walls of a building and monitors the process of cleaning; the water for the jets (12) may be supplied from the water tank on the top of a building; the monitor (13) is a remotely controlled instrument (for example, a common CCD monitor) which can move and rotate over a wide angle (in FIGS. 1 and 2 describing this invention the monitor is in a state of horizontal movement ) that the situation of the cleaning of a building wall is transmitted to the control canter in the building.

Also several lamps (14) are installed on the inner face and near four conners of the elevator cage (10) for the operation of the elevator cage (10) and the monitor (13) at nights. Several detergent jets (15) are also installed to provide detergent for the wall cleaning; they work with a detergent container (16) and a water pump (17) on one side of the elevator (10). Also two rails (20) whose cross section takes a M shape are installed on two lateral sides of the elevator cage (10); a pulley rod (21) and a sucker rod (22) are fixed at the top end and the bottom end of the rail (20) respectively, which are hydraulic-pressure driven by an oil pressure pump (23) installed on one side of the elevator cage (10). Also at the ends of the pulley rod (21) and the sucker rod (22) there are a pulley (211) and a sucker (221), which are extended to contact and to stick to a building wall for the stabilization and the positioning of the elevator cage (10) as those rods (21, 22 ) are driven by the oil pressure pump (23).

Furthermore, a control box (30) containing circuits for multiple time-sequence automatic control is installed to control the sequential operation of the winding machines (11), the water pump (17), and the oil pressure pump (23); the box (30) also controls a primary motor (40) and a secondary motor (41) on two sides of the elevator cage (10) respectively. The rotor of the primary motor (40) is coupled to one of a pair of washing rotary arms (50) which are on two lateral sides of the elevator cage (10) to be its pivot; the rotary arm (50), being driven by the primary motor (40), may take a 180-degrees turn. Two transverse rods (51) and (52) in parallel are installed between the rotary arm pair (50) at their two ends, which allows the installation of a brush set for vertical washing (53) and another brush set for horizontal washing (54) on respective rods. The vertical brush set (53) is connected to the rotor of the secondary motor (41) through a chain (53 1) contained in one rotary arm (51), which affects the operation of its vertical cleaning. On the other hand, the horizontal brush set (54) is coupled with a driving motor (54 1) and a displacement control unit (542) which makes the brush set (54) to rotate and to extend against a building wall; the displacement control unit (542), powered by oil pressure, guides the brush set (54) to shift in the forward, backward, right, and left direction. There is also a bearing (543) formed along the horizontal rod (52), on which the horizontal driving motor (541) may drive the displacement control unit (542) and the horizontal brush set (54) to move in the right and the left directions, affecting the horizontal washing. The above describes the whole structure of this invention as a high-rise building cleaning machine (100).

Figure 3:
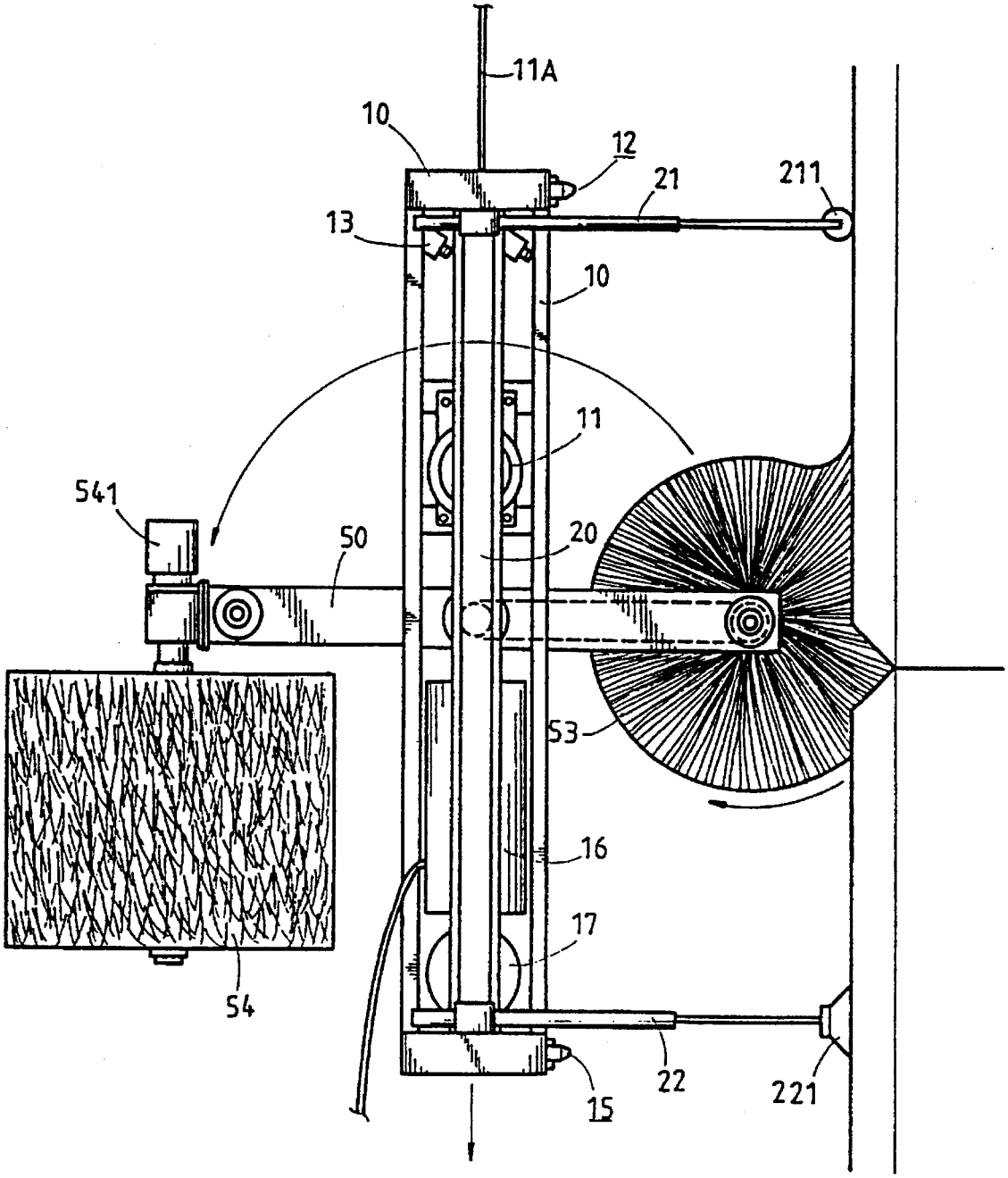
FIG. 3 is a side view of the invention which shows a state of operation of the horizontal and the vertical brush sets attached to the elevator cage.
Figure 4:
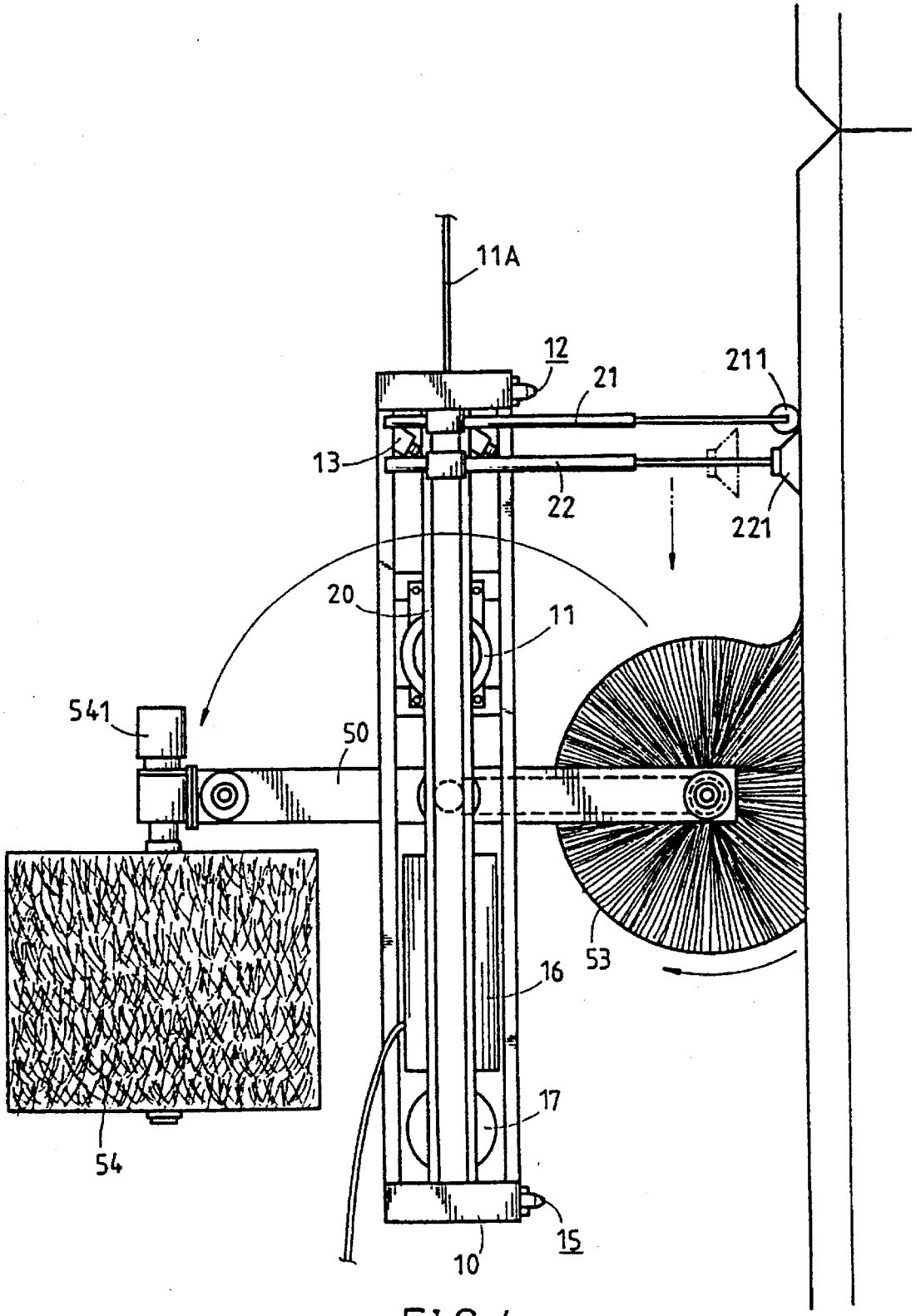
FIG. 4 is a side view of the invention which shows another state of operation of the horizontal and the vertical brush sets attached to the elevator cage.

As shown in FIGS. 3 and 4, the practical operation of the high-rise building cleaning machine (100) described by FIGS. 1 and 2 is that firstly the winding machines (11) bring the elevator cage (10) to move upward or downward along a outer wall of a building to a position for washing, and secondly the oil pressure pump (23) drives the pulley rod (21) and the sucker rod (22) in that the pulley (211) and the sucker (221) are extended to contact and to stick on the building wall, and the elevator cage (10) is thus held in fixed position on the wall; the complete washing acts performed by both the vertical brush set (53) and the horizontal brush set (54) are achieved after a 180-degree turn of the rotary arm (50), and the outer wall of the building is thus effectively washed. After that the elevator cage (10) moves down further, and, at the same time, the sucker rods (22) move toward the pulley rods (21) along the rails (20) so that the track of cleaning is fixed, which assures a exhausted coverage over the outer walls of a building. The advantages and effectiveness of this invention as a high-rise building cleaning machine (100) for washing the outer walls of a building are listed below:

(1) fully automatic cleaning, simple operation, and saving work time and man power This invention as a high-rise building cleaning machine (100) adapts simple, fully automatic control in its operation. As a result the work time and the cost for the building cleaning are reduced.

(2) accurate washing without blind spots, and real-time monitoring of the state of cleaning This invention as a high-rise building cleaning machine (100) adapts fully automatic control in that manual washing is not needed and the 180-degree turn taken by the rotary arm pair (50), coupled with the washing acts by the vertical brush set (53) and the horizontal brush set (54), assures exhausted washing of the outer walls of a building that the blind spots due to the limitation manual washing are avoided; the state of washing can be closely monitored by a monitor (13), preventing any error.

(3) complete abandoning of manual washing which insures the safety during its operation This invention as a high-rise building cleaning machine (100) abandons the usage of man power which may remove the risk of accidents caused by the ignorance of washing workers and hazards occurring to them.

To summarize, this invention as a high-rise building cleaning machine is a new design full of originality, whose characteristic configuration indeed fulfills convenient operation, time-saving, and the insurance of operational safety, and therefore satisfies the criterion of improvement and invention for a new patent. We thus file such a patent application.

I claim:

1. A high-rise building cleaning machine, comprising:

an elevator cage, taking the form of a rectangular frame, on top of which several detergent jets are installed;

at least one pair of winding machines fixed on two lateral sides of said elevator cage which supply the power for the elevation of said elevator cage;

a detergent container and a water pump, installed on one lateral side of said elevator cage, for supplying the detergent water that will be ejected through said detergent jets;

at least one pair of driving motors installed in appropriate positions on two lateral sides of said elevator cage;

a pair of rotary washing arms between which two transverse rods in parallel and in the horizontal direction are installed in 180 degrees separation about a pivot axis of said rotary arms; one side of each said rotary arm is attached to a respective lateral side of the said elevator through connecting with a rotor shaft of a respective one of said driving motors, by which said rotary arms can be driven by said driving motors to turn 180 degrees;

a vertical brush set, fixed around one said transverse rod of said rotary arm pair, which is made to perform the act of washing in the vertical direction by the rotation of the said one transverse rod, driven by one of said driving motors; and a horizontal brush set, connected to said other transverse rod, which may move along the said transverse rod to perform the act of washing in the horizontal direction; wherein said elevator cage, driven by said winding machines, moves vertically into an appropriate position for washing the outer wall of a high-rise building; being forced to touch the wall, said vertical and horizontal brush sets, fixed on said rotary washing arm pair which can be driven to turn 180 degrees by one of said driving motors, take turns to perform their respective acts of vertical and horizontal washing.

2. A high-rise building cleaning machine as recited in claim 1, wherein the water for washing the outer wall of a building is further ejected from several water jets on the bottom of said elevator.

3. A high-rise building cleaning machine as recited in claim 1, containing:

at least one monitor on the top of said elevator cage for monitoring the state of washing the outer wall of a building.

4. A high-rise building cleaning machine as recited in claim 3, wherein said at least one monitor is a CCD monitor.

5. A high-rise building cleaning machine as recited in claim 4, wherein said CCD monitor can move horizontally and rotate in various directions to monitor a wide area.

6. A high-rise building cleaning machine as recited in claim 1, wherein the two lateral sides of said elevator cage each contain a rail, upper ends of each of said rails are connected to a pulley rod; and a sucker rod respectively connected to a lower end of each of the rails providing a means for positioning and stabilization of said elevator cage.

7. A high-rise building cleaning machine as recited in claim 6 wherein said pulley rods are fixed on said rails while said sucker rods can move along said rails.

8. A high-rise building cleaning machine as recited in claim 7, containing:

a pulley and a sucker that are installed respectively at ends of each of said pulley rods and said sucker rods by which said elevator cage is held in a fixed position on the outer wall of a building.

9. A high-rise building cleaning machine as recited in claim 8 wherein extension of said pulleys and said suckers, resulting in a contact with a wall of a building, is controlled by hydraulic pressure.

10. A high-rise building cleaning machine as recited in claim 6, containing:

an oil pressure pump installed on one lateral side of said elevator cage for driving said pulley rods and said sucker rods.

11. A high-rise building cleaning machine as recited in claim 1, containing:

one of said driving motors being installed on an upper side of said horizontal brush set for driving the horizontal brush set to perform an act of washing through its rotation.

12. A high-rise building cleaning machine as recited in claim 11, wherein the upper side of said horizontal brush set contains a movement-control unit for controlling the horizontal shift of said horizontal brush set being in contact with a wall of a building.

13. A high-rise building cleaning machine as recited in claim 12 wherein said movement-control unit is driven by an oil pressure pump.

* * * * *